US008056494B1

(12) United States Patent
Shalley

(10) Patent No.: US 8,056,494 B1
(45) Date of Patent: Nov. 15, 2011

(54) PROPELLING APPARATUS FOR A FLOTATION DEVICE

(75) Inventor: Jack E Shalley, Lee's Summit, MO (US)

(73) Assignee: Tube Scooter, LLC, Lee's Summit, MO (US)

( * ) Notice: Subject to any disclaimer, the term of this patent is extended or adjusted under 35 U.S.C. 154(b) by 0 days.

(21) Appl. No.: 12/832,622

(22) Filed: Jul. 8, 2010

(51) Int. Cl.
*B63B 3/00* (2006.01)

(52) U.S. Cl. ..... 114/346; 114/363

(58) Field of Classification Search ..... 114/345, 114/346, 363; 440/6; 441/130, 132; 297/314
See application file for complete search history.

(56) References Cited

U.S. PATENT DOCUMENTS

| | | | | |
|---|---|---|---|---|
| 4,021,873 | A * | 5/1977 | Francois | 114/345 |
| 4,367,689 | A * | 1/1983 | Lukehart et al. | 114/346 |
| 5,101,753 | A * | 4/1992 | Hull et al. | 114/345 |
| 5,331,914 | A * | 7/1994 | Salmons | 114/346 |
| 6,010,382 | A | 1/2000 | Kennedy | |
| 6,168,489 | B1 | 1/2001 | Huston | |
| 6,312,054 | B1 * | 11/2001 | Scheurer et al. | 441/130 |
| 6,543,378 | B1 * | 4/2003 | Johnson, Sr. | 114/346 |
| 6,962,124 | B1 * | 11/2005 | North et al. | 114/346 |

* cited by examiner

*Primary Examiner* — Lars A Olson
(74) *Attorney, Agent, or Firm* — David E. Herron, II

(57) ABSTRACT

The disclosure depicts and describes flotation device including a deck, and a chaira seat on the deck. A well extends downwardly from the deck, and a ledge extends upwardly from the deck. The deck has an aperture positioned adjacent the ledge; additionally, the invention includes a motor having a power head and tiller positioned above the deck, a shaft passing through the aperture, and a propeller adjacent the terminal end of the shaft.

11 Claims, 5 Drawing Sheets

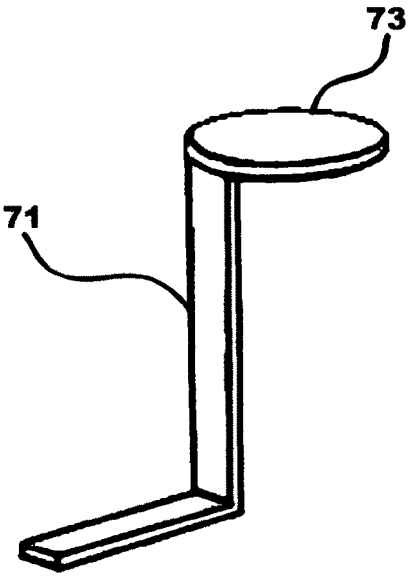
Fig. 5
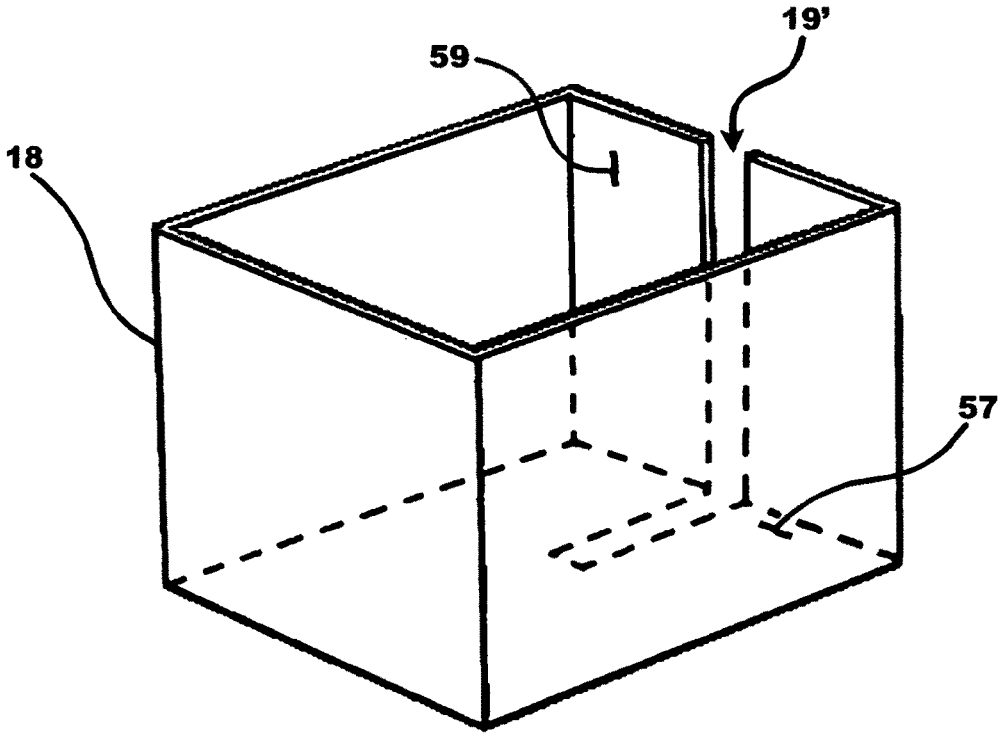

PROPELLING APPARATUS FOR A FLOTATION DEVICE

BACKGROUND OF THE INVENTION

The invention is a propelled flotation device. The invention includes a deck having a chair positioned on the deck. A well extends downwardly from the deck, and a ledge extends upwardly from the deck. Moreover, an aperture is formed in the deck adjacent the ledge. The invention also includes a motor having a power head and tiller positioned above the deck, and a propeller positioned on a terminal end of a shaft that extends to a second end positioned below the deck. The shaft passes through the aperture in the deck so that the propeller, positioned adjacent the terminus of the shaft, will penetrate the surface of water.

A clamp couples the motor to the deck, preferably by affixing the shaft of the motor to the ledge that is formed on the deck. In a preferred embodiment of the device, the chair has a seat back rotatably coupled to the deck and selectively positionable between a down position wherein the seat back is generally parallel the deck, and an upright position wherein the seat back is generally orthogonal the deck. The chair may also have a bottom positioned on the deck.

In one embodiment, the device includes a cover positionable over the well. However, in another embodiment, the underneath surface of the seat bottom bears ridges extending downwardly from its underneath surface to frictionally engage within the battery well, enabling the seat portion of the chair to serve as a well cover.

The inventive device works well in combination with a standard annular ring, such as a foam (i.e., Styrofoam) ring or a typical inflatable inner tube with a central opening. In this embodiment, the deck and central opening are cooperatively formed such that the deck engages the inflatable ring and covers the central opening. However, other configurations for a flotation device are certainly possible.

The motor has a shaft that extends through the central opening in the in the annular ring and also through the deck as well. The inventive device also preferably includes a clamp affixing the motor (at its shaft) to the deck (at the ledge) such that the motor is selectively positionable between an in-use position wherein the shaft is extends orthogonally downward from the deck and a stowed position wherein the shaft is adjacent and/or parallel the deck.

In a preferred embodiment, the device includes a battery positioned within the well and configured to empower the motor. In the preferred embodiment, a pair of lead cables connect the battery to the motor by passing through apertures formed on the well. Alternatively the device may be propelled by a fuel-driven motor, and a fuel tank may be stowed within the well. In this alternate embodiment, fuel lines will pass through openings in the well and connect the tank in the well to a fuel-driven motor.

Other objects, advantages and novel features of the present invention will become apparent from the following detailed description of the invention when considered in conjunction with the accompanying drawings.

BRIEF DESCRIPTION OF THE DRAWINGS

FIG. 5 is a perspective view showing a preferred embodiment of the battery well.

DETAILED DESCRIPTION OF THE PREFERRED EMBODIMENTS

Figure 1:
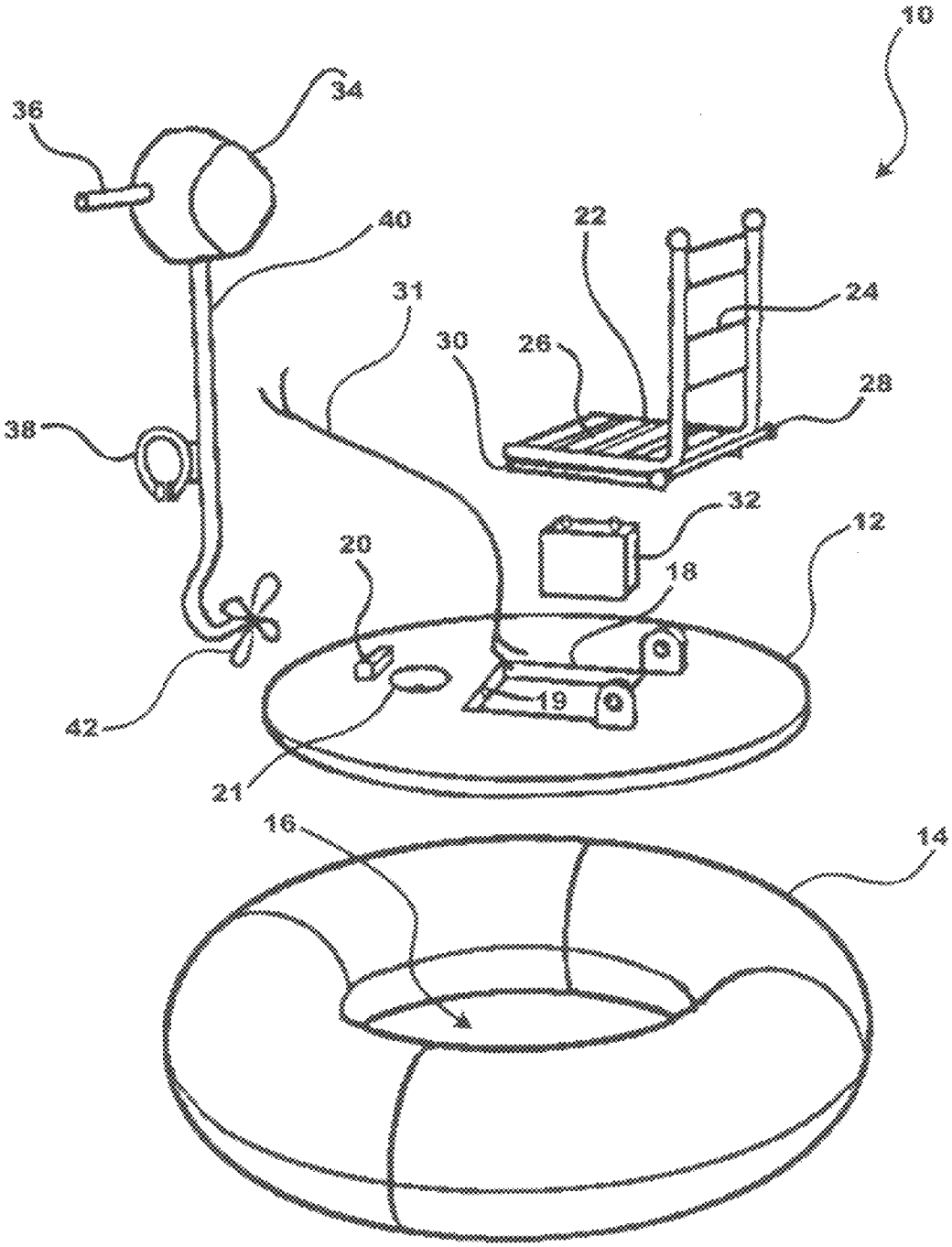
FIG. 1 is an exploded and perspective view detailing the inventive flotation device.

FIG. 1 is an exploded and perspective view of a first embodiment of the inventive device 10. The device 10 includes a deck 12 configured to cover the inner void 16 of an annular ring 14, such as an inflatable tube that is shown. The deck 12 includes a battery well 18 depending downwardly from a top surface and configured to receive a battery 32. The deck further includes a hole 21 formed between the battery well and a ledge 20 that is positioned near the front end of the deck 12. This hole 21 should be large enough to allow the propeller 42 of a motor 34 to pass therethrough as the device 10 is assembled. Although shown as a hole 21 confined to a front portion of the deck 12, the hole 21 may extend to the battery well 18. This alternate configuration (although not shown) of an elongate hole 21 that meets the battery well 18 eases the task of passing the propeller 42 through the deck 12.

The device 10 also includes a motor 34, such as an electric motor having a tiller 36 and a clamp 38 positioned on a shaft 40. The shaft 40 terminates with a propeller 42, which will dip below the surface of the water when the device is in use. In that regard, the shaft passes through the hole 21 in the deck 12 such that the propeller 21 engages the water, and the tiller 36 of the motor 34 is available to enable one to steer the device 10. In the preferred embodiment shown, the motor 34 is an electric motor empowered by the battery 32 that is stored within the battery well 18. Lead cables 31 pass through a hole 19 in the battery well and the hole 21 in the deck 12 in order to establish electric communication between the battery 32 and the motor 34.

Still referring to FIG. 1, a ledge 20 is formed on the deck near the hole 21. In order to affix the motor 34 to the deck 12, the clamp 38 is affixed to the ledge 20. Of course, the clamp 38 is configured to retain the shaft 38 of the motor 34 generally perpendicular to the deck 12, yet allow an operator to transmit steering torques through the shaft via the tiller 36.

As shown in FIG. 1, the device 10 further includes a chair 22 positioned on the deck 12. The chair 22 includes a back 24 and a seat 26 that are coupled to one another. In a preferred embodiment, the back 24 and seat 26 are rotatably coupled to one another by a rod 28 that passes through each. In this embodiment, the chair 24 is attached to the deck by passing the rod 28 through ears mounted on the deck 12.

Still referring to FIG. 1, the bottom 26 of the chair 22 may be equipped with ridges 30 that are cooperatively formed to mate with the battery well 18, such that the bottom 26 acts as a cover for the battery well 18; of course, the seat 26 is selectively positionable between a closed position (wherein the ridges 30 of the seat 26 engage within the battery well 18) and an open position by rotating the seat about rod 28.

Figure 2:
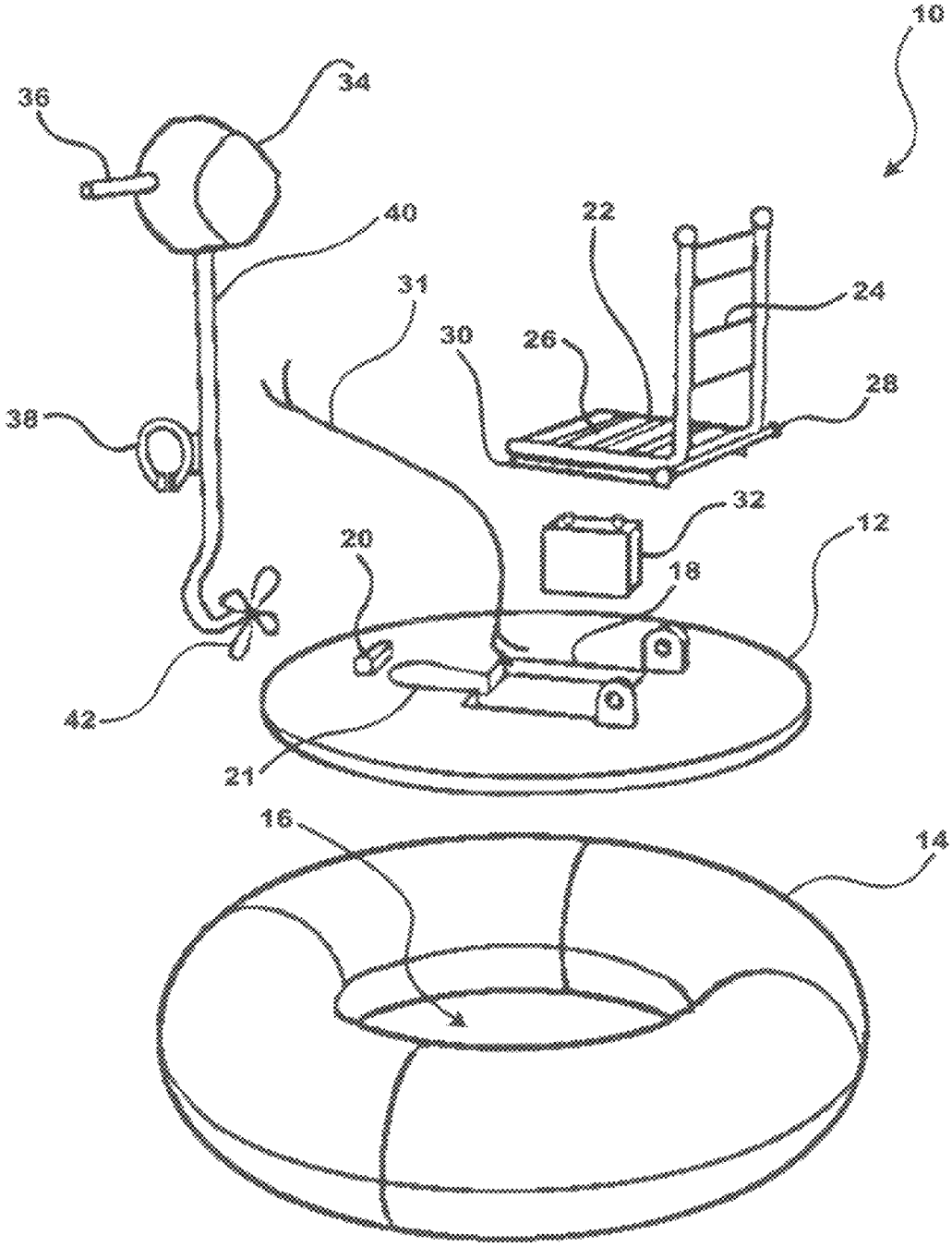
FIG. 2 is a perspective view of the flotation device in an assembled condition.

FIG. 2 is an exploded and perspective view of a second embodiment of the inventive device 10. Similar to the first embodiment shown, the device 10 includes a deck 12 configured to cover the inner void 16 of an annular ring 14, such as an inflatable tube that is shown. The deck 12 includes a battery well 18 depending downwardly from a top surface and configured to receive a battery 32. The deck further includes a hole 21 is positioned near the front end of the deck 12. In the second embodiment shown in FIG. 2, the hole 21 extends to a front portion of the battery well 18. This alternate configuration eases the task of passing the propeller 42 through the deck 12.

Still referring to FIG. 2, the device 10 also includes a motor 34, such as an electric motor having a tiller 36 and a clamp 38 positioned on a shaft 40. The shaft 40 terminates with a propeller 42, which will dip below the surface of the water when the device is in use. In that regard, the shaft passes through the hole 21 in the deck 12 such that the propeller 21 engages the water, and the tiller 36 of the motor 34 is available to enable one to steer the device 10. In the preferred embodiment shown, the motor 34 is an electric motor empowered by the battery 32 that is stored within the battery well 18. Lead cables 31 pass through a hole 19 in the battery well and the hole 21 in the deck 12 in order to establish electric communication between the battery 32 and the motor 34.

Still referring to FIG. 2; a ledge 20 extends upwardly from the deck 12 and is positioned near the hole 21. In order to affix the motor 34 to the deck 12, the clamp 38 is affixed to the ledge 20. Of course, the clamp 38 is configured to retain the shaft 38 of the motor 34 generally perpendicular to the deck 12, yet allow an operator to transmit steering-torques through the shaft via the tiller 36.

Figure 3:
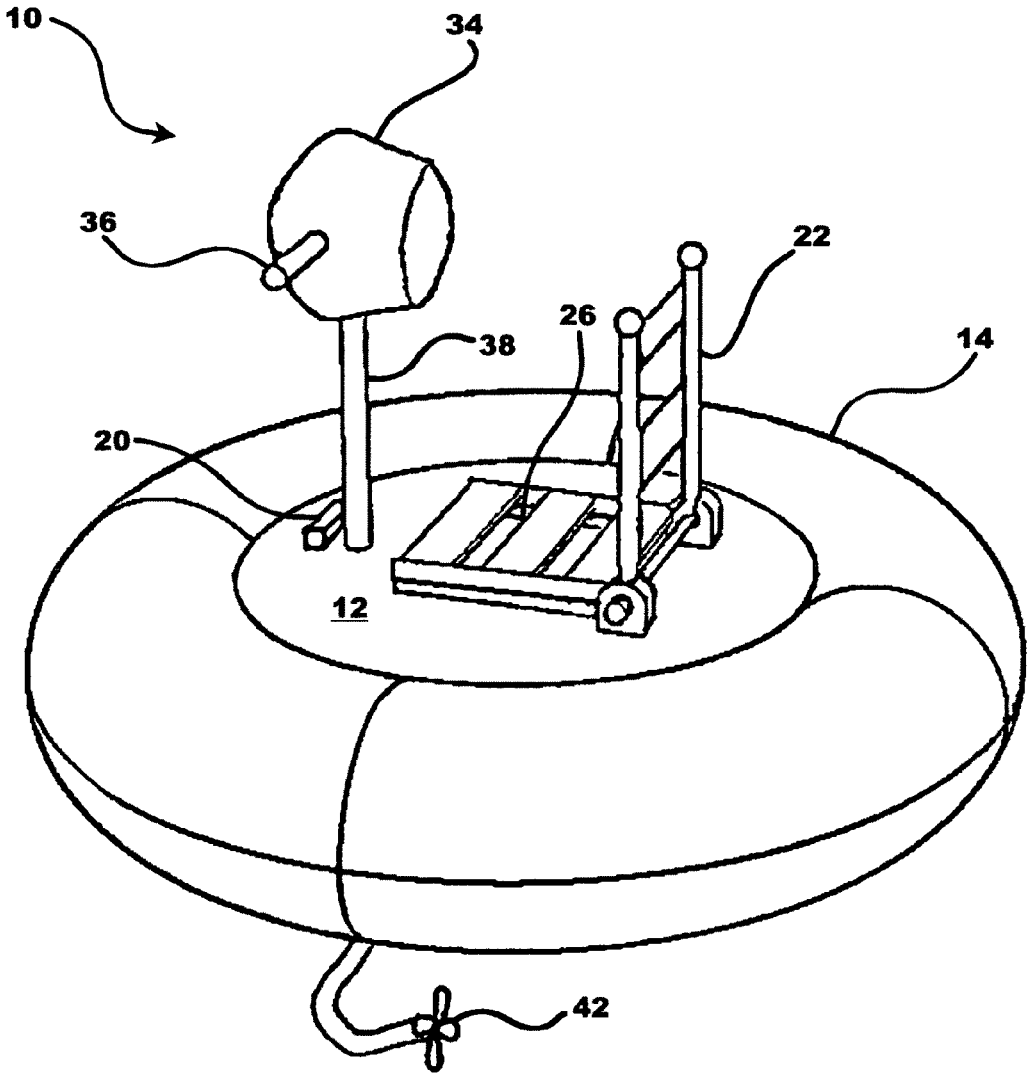
FIG. 3 is a perspective and exploded view isolating the battery well and chair assembly, according to the principles of the invention.

FIG. 3 shows a perspective view of a first embodiment of the device 10, shown in an assembled condition. As shown, the deck 12 covers a void portion of an inflatable annular ring 14. Of course, other configurations and styles of flotation devices are also within the scope of the inventive concept. For example, instead of using the deck 12 in combination with an inflatable annular ring 14 as shown, a foam annular ring would also be suitable, as would a pair of parallel floatables (like a pontoon arrangement) are also well-suited for the spirit of the invention. Additionally, a typical raft would work, provided the raft is provided with an opening allowing a motor shaft to engage the water.

Figure 4:
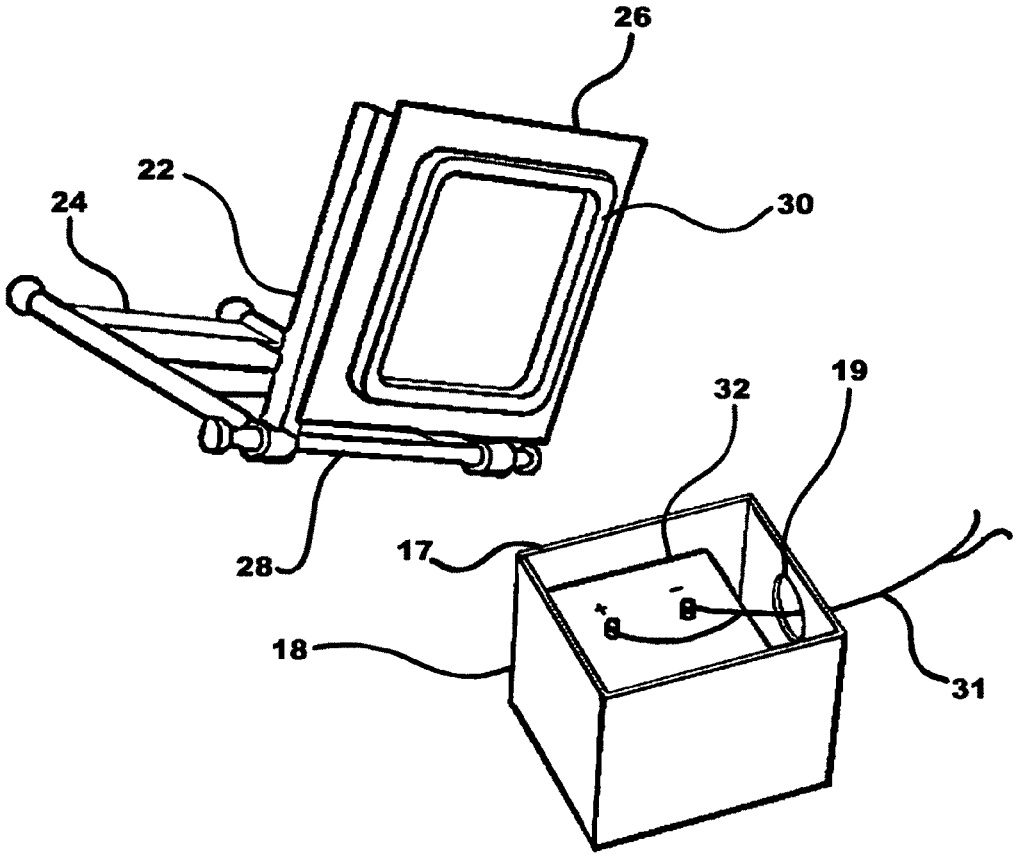
FIG. 4 is a perspective view isolating an alternate embodiment of the battery well.

Still referring to FIG. 3, a chair 22 is mounted to the deck such that the seat 26 covers (and is secured within) the battery well (viewable in FIG. 1; see also FIG. 4). The motor 34 is clamped to a ledge 20 that is positioned in a forward portion of the deck 12. A clamp affixes the shaft 38 to the ledge 20 in such a manner that allows relative rotation, thereby allowing an operator to transmit steering torques to the propeller 22 by selectively turning the tiller 36 of the motor 34.

The preferred embodiment of the device 10 uses an electric motor 34; however, a motor 34 powered by fuel is also within the scope of the invention. In the preferred embodiment, the seat 26 of the chair 22 covers a battery well which houses a dry cell that is in electric communication with the motor. In this embodiment, the lead cables provide electromotive force to the motor 34. Analogously, however, a fuel tank may be positioned beneath the seat 26 of the chair 22 with a fuel line passing from the tank in the well to the motor 34.

FIG. 4 is a perspective view isolating the chair 22 and the battery well 18. In preferred embodiments, the battery well 18 and the deck (shown previously) comprise a unitary, monolithic, one-piece structure. However, the battery well 18 may optionally comprise a separate part that is insertable into the deck 12. The battery well 18 receives and retains a battery 32. In a preferred embodiment, the battery 32 comprises a 12-Volt cell, such as a typical automobile battery. Lead cables 31 attach at a first end to terminals of the battery 32, then pass through an opening 19 and connect at a second end to the motor (see FIGS. 1,2).

As shown in FIG. 4, the lower surface of the seat 26 of the chair includes ridges 30 that are cooperatively formed to frictionally engage within the upper perimeter 17 of the battery well 18. A frictional fit is preferred, as this will allow the seat 26 to act not only as a cover for the battery well 18, but it will also create a more stable device by holding the seat in place on the deck. As shown, the chair 22 comprises a seat 26 and a back 24 that are rotatably coupled to one another by means of a rod 28, which is affixed to the deck, usually by means of ears extending upwardly from a top surface of the deck (see FIGS. 1-3).

FIG. 5 is a perspective view that isolates a second embodiment of the battery well 18. In this embodiment, the well 18 bears an slot 19' that extends from an upper edge to the bottom edge of the front wall 59. The slot 19' also extends at least partway along the bottom 57 of the battery well 18.

The embodiment shown in FIG. 5 allows one to extend battery cables (see FIG. 3) from the well 18, through the slot 19' and to the motor (FIGS. 1,2). Once the cables are threaded through the slot 19', a cover 71 is inserted into the well so that it fits into the slot 19.' The cover 71 may also include a portion 73 extending outwardly from the battery well 18 in order to cover an opening in the deck (See FIGS. 1,2).

Having described and illustrated the invention in detail, it is to be understood that the above and foregoing is for illustration and demonstration only. The descriptions herein are not intended to limit the breadth of this invention. The breadth and scope of the invention shall be limited only by claims.

The invention claimed is:

1. A flotation device including:

a deck;

a chair on a face of the deck, the chair further comprising a seat back rotatably coupled to the deck and selectively positionable between a down position wherein the seat back is generally parallel the deck, and an upright position wherein the seat back is generally orthogonal the deck;

a well extending-downwardly from the deck;

a ledge extending upwardly from the deck;

an aperture in the deck and positioned adjacent the ledge;

a motor having a power head and tiller positioned above the deck, the motor further including a shaft passing through the aperture, and a propeller adjacent a terminal end of the shaft;

a clamp for coupling the motor to the deck.

2. The flotation device as in claim 1, the chair further comprising a seat bottom positioned on the deck.

3. The flotation device as in claim 1, further comprising a cover that is removably positioned over the well.

4. The flotation device as in claim 1, the seat further comprising a seat bottom removably positioned on the deck.

5. The flotation device as in claim 4, the seat bottom further including a sitting surface and an underneath surface; wherein, the underneath surface of the seat bottom bears ridges extending downwardly from the underneath surface to frictionally engage within the well.

6. The flotation device as in claim 1, further including an annular ring having a central opening; wherein, the deck and central opening are cooperatively formed such that the deck engages the annular ring and covers the central opening.

7. The flotation device as in claim 6, wherein the motor bears a shaft that extends through the central opening in the in the annular ring.

8. The flotation device as in claim 1, the clamp being rotatable such that a shaft of the motor is selectively positionable between an in-use position wherein the shaft extends orthogonally downward from the deck and a stowed position wherein the shaft is adjacent the deck.

9. The flotation device as in claim 1, further including a battery empowering the motor and positioned within the well.

10. The flotation device as in claim 9, further including a pair of lead wires extending from the battery and engaging the motor by passing through apertures formed along walls in the well.

11. A flotation device including:

an inflatable ring adapted to float on water and having a central opening;

a deck formed to engage the inflatable ring and cover the central opening;

a chair comprising a seat bottom, and further including a seat back rotatably coupled to the deck and selectively positionable between a down position wherein the seat back is generally parallel the deck, and an upright position wherein the seat back is generally orthogonal the deck;

a well extending downwardly from the deck;

flanges depending downwardly from a lower surface of the seat bottom, the flanges configured to engage within the well;

a ledge extending upwardly from the deck;

an aperture in the deck and positioned adjacent the ledge;

a motor having a power head and tiller positioned above the deck, the motor further including a shaft passing through the aperture, and a propeller positioned adjacent a terminal end of the shaft;

a clamp for coupling the motor to the deck.

* * * * *